US010612149B1

(12) United States Patent
Cheung et al.

(10) Patent No.: US 10,612,149 B1
(45) Date of Patent: Apr. 7, 2020

(54) PLATINUM ELECTRODEPOSITION BATH AND USES THEREOF

(71) Applicant: CHOW SANG SANG JEWELLERY COMPANY LIMITED, Hong Kong (CN)

(72) Inventors: Wai Kei Cheung, Hong Kong (CN); Shuk Kwan Mak, Hong Kong (CN); Candice Wing Jong Tong, Hong Kong (CN)

(73) Assignee: CHOW SANG SANG JEWELLERY COMPANY LIMITED, Hong Kong (CN)

( * ) Notice: Subject to any disclaimer, the term of this patent is extended or adjusted under 35 U.S.C. 154(b) by 0 days.

(21) Appl. No.: 16/562,431

(22) Filed: Sep. 5, 2019

(51) Int. Cl.
*C25D 3/52* (2006.01)
*C25D 7/00* (2006.01)
*C25D 5/16* (2006.01)

(52) U.S. Cl.
CPC ..... *C25D 3/52* (2013.01); *C25D 5/16* (2013.01); *C25D 7/005* (2013.01)

(58) Field of Classification Search
CPC ..... C25D 3/50; C25D 3/52
USPC ..... 205/264
See application file for complete search history.

(56) References Cited

U.S. PATENT DOCUMENTS

| | | | | |
|---|---|---|---|---|
| 1,906,178 | A | 4/1933 | Powell et al. | |
| 4,486,274 | A | 12/1984 | Abys et al. | |
| 5,529,680 | A | 6/1996 | Kitada et al. | |
| 5,549,738 | A | 8/1996 | Kitada et al. | |
| 5,620,583 | A | 4/1997 | Kuhn et al. | |
| 2006/0012044 | A1* | 1/2006 | Knop | C25D 5/18 257/750 |
| 2012/0318341 | A1* | 12/2012 | Fisher | H01L 31/0216 136/256 |
| 2013/0334056 | A1* | 12/2013 | Ashfield | C25D 3/50 205/264 |
| 2015/0368819 | A1* | 12/2015 | Zhang | C25D 3/56 205/239 |

FOREIGN PATENT DOCUMENTS

| | | | | |
|---|---|---|---|---|
| CN | 1283711 | A | 2/2001 | |
| CN | 101974770 | A | 2/2011 | |
| CN | 103492618 | A | 1/2014 | |
| EP | 3067444 | A2 | 9/2016 | |
| JP | S56163293 | A | 12/1981 | |
| JP | 2006213945 | A * | 8/2006 | C25D 3/56 |

OTHER PUBLICATIONS

Somei Yarita et al.; Alkaline Platinum Electroforming Bath Using Hexahydroxoplatinate; Journal of The Surface Finishing Society of Japan. Jul. 1, 1997; 48(7): 719-722.

Somei Yarita; Platinum, Platinum Alloy Plating and Platinum Group Metals Electroforming Technology; Journal of The Surface Finishing Society of Japan. 2004; 55(10): 646-650.

* cited by examiner

*Primary Examiner* — Edna Wong
(74) *Attorney, Agent, or Firm* — Law Offices of Albert Wai-Kit Chan, PLLC

(57) ABSTRACT

This invention relates to a platinum electrodeposition bath which is capable of forming platinum deposits having an attractive shiny granular surface like a velvet, which is particularly useful in jewelry manufacturing. The velvet effect can be illustrated by comparing the surface roughness with a bright smooth platinum deposit.

21 Claims, 2 Drawing Sheets

PLATINUM ELECTRODEPOSITION BATH AND USES THEREOF

BACKGROUND OF THE INVENTION

This invention relates to a platinum electrodeposition bath (suitable for both electroplating & electroforming) which gives a platinum deposit with an attractive shiny granular surface, resembling a velvety texture. This unprecedented surface effect of platinum electrodeposit differentiates from the conventional bright or matte platinum electrodeposits. The term "velvet platinum electrodeposition" is used in this specification to refer to the invention. The present invention provides a new application in decorative uses of platinum electrodeposition.

Platinum electroplating & electroforming have been widely used in the manufacture of ornament and jewelry items, not only because of the bright luster and aesthetic attractiveness of platinum, but also its high chemical inertness. The currently available platinum electrodeposition baths give either bright or matte Pt deposits. For example, in U.S. Pat. No. 5,549,738 & 5,620,583, platinum electrodeposition baths giving bright surface were disclosed. In a very early invention U.S. Pat. No. 1,906,178, it was disclosed that matte Pt electrodeposit was obtained by adjusting the pH of the bath. However, "velvet platinum electrodeposition" has never been reported.

On the contrary, both bright gold electrodeposition and velvet gold electrodeposition are well known in the jewelry industry. The latter is commonly used in the manufacture of hollow statue-like ornaments. Furthermore, bright and velvet silver electrodepositions are also commercially available. The techniques for velvet platinum electrodeposition have never been materialized, so there is a need to develop such technique to satisfy any situation where there is such a need, for example, the jewelry industry.

SUMMARY OF THE INVENTION

The object of the present invention is to provide a platinum electrodeposition bath which gives a unique shiny granular platinum deposit of high purity, such that the surface has an attractive velvety effect. The grain structure of velvet platinum deposit contrasts greatly with both the bright and matte platinum deposits. The surface morphology of velvet platinum was characterized by 3D optical surface profilometry & SEM. The surface roughness, expressed in $S_a$, is found to be up to 25 times of that of bright platinum deposit. This desirable grain feature is favorable for jewelry manufacturing. The velvet platinum electrodeposition bath of this invention may also be used in applications other than decorative purposes.

Definitions and Abbreviations

The following terms shall be used to describe the present invention. In the absence of a specific definition set forth herein, the terms used to describe the present invention shall be given their common meaning as understood by those of ordinary skill in the art.

As used herein, the expression SEM refers to scanning electron microscopy.

As used herein, the expression $S_a$ refers to arithmetical mean height of the surface.

As used herein, the expression DC refers to direct current.

As used herein, the expression PEG refers to polyethylene glycol.

DETAILED DESCRIPTION OF THE INVENTION

Figure 1:
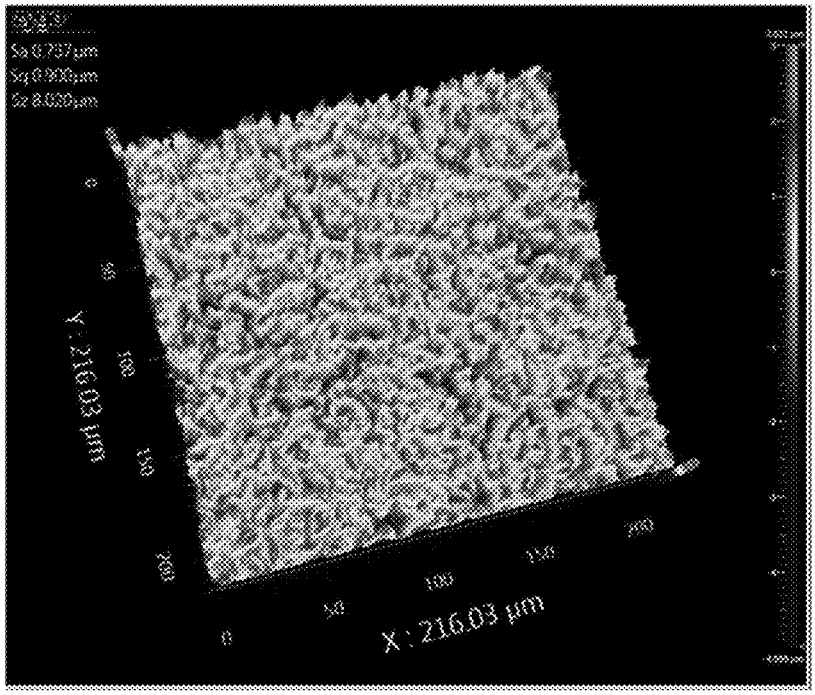
FIG. 1 is the 3D surface profile of the velvet platinum deposit at 40× magnification, showing the $S_a$ is 0.737 μm.

In one embodiment, this invention provides a platinum electrodeposition bath. In another embodiment, said platinum electrodeposition bath produces a platinum surface with an arithmetical mean height greater than 0.4 μm. In a further embodiment, said platinum electrodeposition bath produces a velvet platinum surface.

In one embodiment, the platinum electrodeposition bath of this invention comprises a platinum salt.

In another embodiment, said platinum salt is any one of the alkali metal salts selected from the group consisting of hexabromoplatinate(IV), hexachloroplatinate(IV), hexahydroxyplatinate(IV), hexathiocyanoplatinate(IV). In a further embodiment, the concentration of platinum metal ranges from 2 to 40 g/L. In yet another embodiment, the concentration of platinum metal ranges from 18-25 g/L. In one embodiment, the alkali metal cation of the platinum salt is sodium or potassium. In one embodiment, the anion of the platinum salt is one or more selected from the group consisting of hexachloroplatinate(IV) and hexahydroxyplatinate(IV). These platinum salt can also be produced by mixing the dihydrogen compound of the above platinum species with an alkaline solution.

In one embodiment, the bath composition comprises an alkali metal hydroxide. In another embodiment, said alkali metal hydroxide comprises sodium hydroxide or potassium hydroxide. In a further embodiment, said alkali metal hydroxide is at a concentration of 1-80 g/L, 15-25 g/L, or 15-20 g/L.

In one embodiment, one or more conducting salts may also be included in the bath composition. Examples include, but are not limited to, bromide, chloride, nitrate, carbonate, hydrogencarbonate, sulphate, hydrogensulphate, phosphate, hydrogenphosphate, dihydrogenphosphate of an alkali metal. The conducting salt can also be an organic species such as formate, acetate, malonate, tartrate, lactate, oxalate, pyruvate, glycerate, glutamate, salicylate, citrate of an alkali metal. The conducting salts are added in a total amount of 2-100 g/L.

In one embodiment, additives such as leveling agents, brighteners, surfactants and the like may also be included in the electrodeposition bath.

In one embodiment, the bath composition comprises saccharin or saccharin sodium salt. In a further embodiment, the concentration of saccharin or saccharin sodium salt ranges from 0.001-10 g/L.

In one embodiment, the bath composition comprises 3,3'-dithiobis-1-propanesulfonic acid or 3,3'-dithiobis-1-propane sulfonic acid disodium salt. In a further embodiment, the concentration of 3,3'-dithiobis-1-propanesulfonic acid or 3,3'-dithiobis-1-propanesulfonic acid disodium salt ranges from 0.0001-10 g/L.

In one embodiment, the bath composition comprises sulfonic acid group substituted polycyclic aromatic hydrocarbons of 2-4 fused benzene rings and the alkali metal salts thereof. In a further embodiment, the sulfonic acid group substituted polycyclic aromatic hydrocarbons of 2-4 fused benzene rings is a compound of formula (1) or the alkali metal salts thereof:

$$Ar—(SO_3H)_n \quad (1)$$

wherein Ar stands for any polycyclic aromatic hydrocarbons of 2-4 fused benzene rings; n is at least 1. In another embodiment, Ar is naphthalene and n is 3. Examples include but are not limited to naphthalene-1,3,6-trisulfonic acid and naphthalene-1,3,6-trisulfonic acid trisodium salt. In yet another embodiment, the concentration of naphthalene-1,3,6-trisulfonic acid and naphthalene-1,3,6-trisulfonic acid trisodium salt ranges from 0.0001-10 g/L.

In one embodiment, the bath composition comprises a platinum(IV) complex of formula (2) as an additive:

$$M_2[Pt(C_2O_4)_x(OH)_y] \quad (2)$$

wherein M is any alkali metal; x is 1, 2 or 3; y is 0, 2 or 4. In a further embodiment, M is potassium; x is 2 and y is 2. Examples include but are not limited to potassium trans-dihydroxobis(oxalato)platinate (IV), i.e. $K_2[trans\text{-}Pt(C_2O_4)_2(OH)_2]$. In yet another embodiment, the concentration of $K_2[trans\text{-}Pt(C_2O_4)_2(OH)_2]$ ranges from 0.0001-1 g/L.

In one embodiment, the bath composition comprises polyethylene glycol (PEG). In a further embodiment, the average molecular weight of PEG ranges from 300-100,000 (i.e. PEG 300-PEG 100,000). In yet another embodiment, the concentration of PEG is 0.001-5 g/L.

In one embodiment, the bath composition comprises a combination of saccharin or saccharin sodium salt, of which the concentration is 0.001-10 g/L, and 3,3'-dithiobis-1-propanesulfonic acid or 3,3'-dithiobis-1-propanesulfonic acid disodium salt, of which the concentration is 0.0001-10 g/L, and $K_2[trans\text{-}Pt(C_2O_4)_2(OH)_2]$, of which the concentration is 0.0001-1 g/L, and a PEG selected from PEG 300-PEG 100,000, of which the concentration is 0.001-5 g/L. In one embodiment, the bath composition comprises a combination of saccharin or saccharin sodium salt, of which the concentration is 0.001-10 g/L, and 3,3'-dithiobis-1-propanesulfonic acid or 3,3'-dithiobis-1-propanesulfonic acid disodium salt, of which the concentration is 0.0001-10 g/L, and $K_2[trans\text{-}Pt(C_2O_4)_2(OH)_2]$, of which the concentration is 0.0001-1 g/L, and naphthalene-1,3,6-trisulfonic acid or naphthalene-1,3,6-trisulfonic acid trisodium salt, of which the concentration is 0.0001-10 g/L, and a PEG selected from PEG 300-PEG 100,000, of which the concentration is 0.001-5 g/L.

In one embodiment, the electrodeposition bath is operated at a temperature range between 60-95° C. In another embodiment, the temperature range is 90-95° C.

In one embodiment, the current density of the bath may be at least 0.5 A/dm$^2$, while not exceeding 6 A/dm$^2$. In another embodiment, current density of the bath is 2-3 A/dm$^2$. Simple direct current or pulse current can be applied to operate the bath.

Conventional platinum electrodeposition apparatus may be used for this bath. Insoluble anodes may be used such as platinized titanium. The substrate for platinum deposition may be a wide range of metals and alloys which are stable in an alkaline medium, including but not limited to, platinum, gold, copper and copper alloys. A thin layer of copper may also be pre-plated on the substrate before the deposition of platinum.

The time of electrodeposition may vary, depending on the desired thickness of the platinum deposit. In one embodiment, the thickness of platinum ranges from 0.1 μm to 300 μm. In another embodiment, the purity of the platinum deposits is at least 99.5 weight percent.

Figure 2:
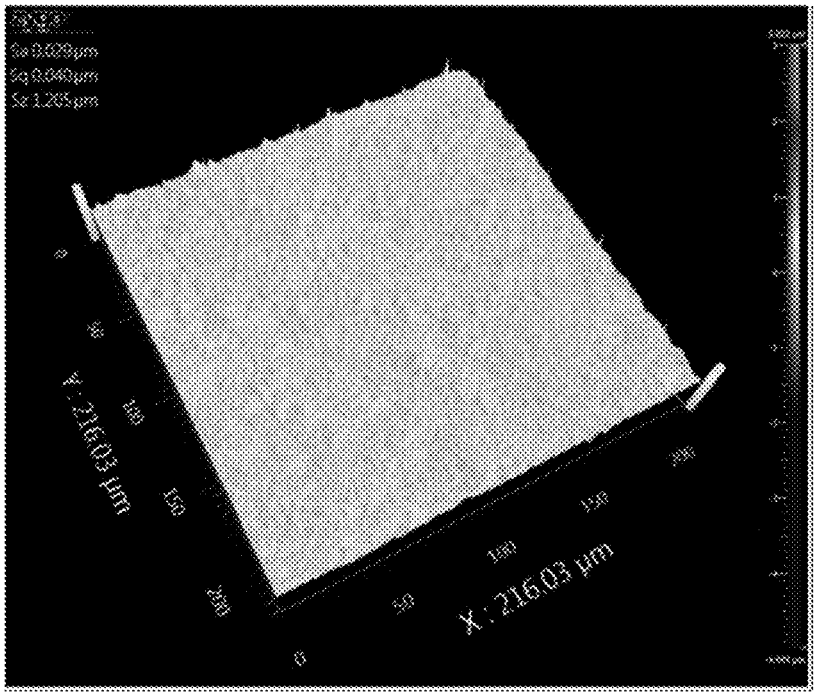
FIG. 2 is the 3D surface profile of a bright platinum deposit at 40× magnification, showing the $S_a$ is 0.029 μm.
Figure 3:
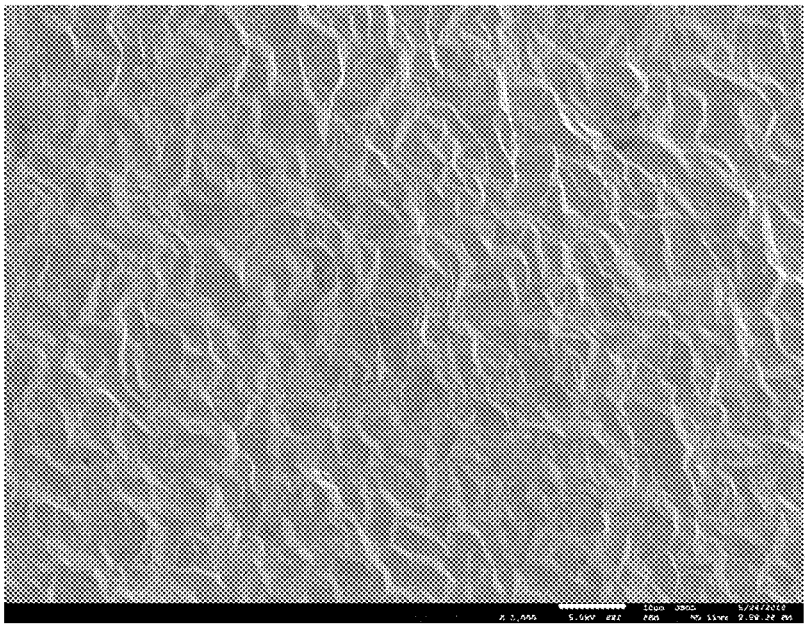
FIG. 3 is the SEM image at 1000× magnification showing the grain features of the velvet platinum deposit.
Figure 4:
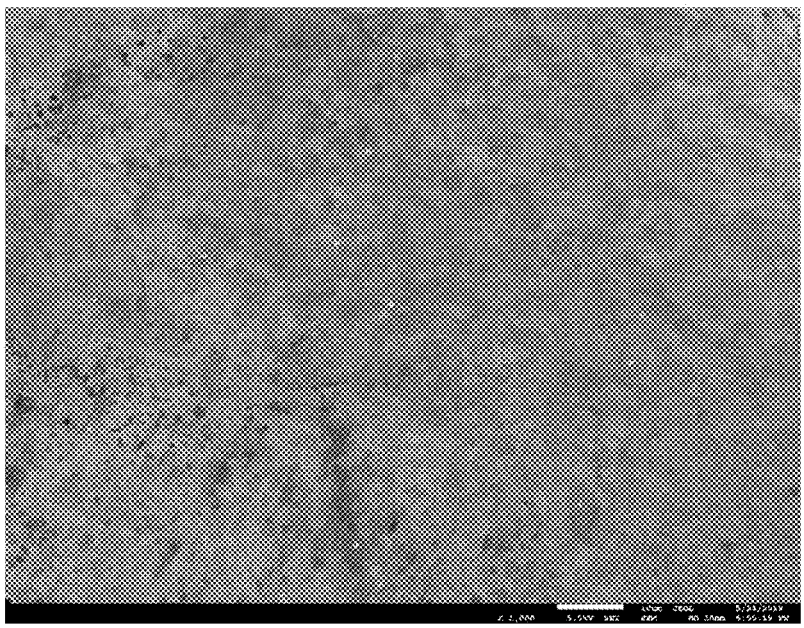
FIG. 4 is the SEM image at 1000× magnification showing the surface morphology of a bright platinum deposit.

In one embodiment, the velvet platinum deposit produced by this bath has a shiny granular structure. In another embodiment, the areal surface roughness expressed in arithmetical mean height of the surface ($S_a$) is at least 0.4 μm. FIG. 1 shows a typical surface profile of the velvet platinum deposit produced by an embodiment of this invention, having an $S_a$ of 0.737 μm. The surface profile of the platinum deposit produced by a commercially available bright platinum electrodeposition bath is shown in FIG. 2 for comparison, in which the $S_a$ is only 0.029 μm. FIGS. 3 & 4 compare the SEM images of the velvet platinum deposit and bright platinum deposit respectively. It is obvious that the velvet platinum has a granular structure which is essential for the shiny velvet appearance.

In one embodiment, this invention provides a platinum electrodeposition bath for depositing a layer of platinum on a substrate, comprising: a) one or more sources of platinum; b) one or more alkali metal hydroxides; c) one or more conducting salts; d) saccharin or saccharin sodium salt; e) 3,3'-dithiobis-1-propanesulfonic acid or 3,3'-dithiobis-1-propanesulfonic acid disodium salt; f) sulfonic acid group substituted polycyclic aromatic hydrocarbons of 2-4 fused benzene rings or its alkali metal salts; g) a platinum(IV) complex of formula $M_2[Pt(C_2O_4)_x(OH)_y]$ as an additive and h) polyethylene glycol with an average molecular weight ranging from 300 to 100,000.

In one embodiment, said one or more sources of platinum comprises an anion selected from the group consisting of hexabromoplatinate(IV), hexachloroplatinate(IV), hexahydroxyplatinate(IV) and hexathiocyanoplatinate(IV).

In one embodiment, said one or more sources of platinum comprises a cation selected from sodium or potassium.

In one embodiment, said platinum electrodeposition bath has a platinum metal concentration of 2-40 g/L.

In one embodiment, said one or more alkali metal hydroxide comprises sodium hydroxide or potassium hydroxide.

In one embodiment, said one or more alkali metal hydroxide is at a concentration of 1-80 g/L.

In one embodiment, said one or more conducting salts is at a concentration of 2-100 g/L.

In one embodiment, said one or more conducting salts comprises sodium salt or potassium salt of bromide, chloride, nitrate, carbonate, hydrogencarbonate, sulphate, hydrogensulphate, phosphate, hydrogenphosphate, dihydrogenphosphate, formate, acetate, malonate, tartrate, lactate, oxalate, pyruvate, glycerate, glutamate, salicylate or citrate.

In one embodiment, said saccharin or saccharin sodium salt is at a concentration of 0.001-10 g/L.

In one embodiment, said 3,3'-dithiobis-1-propanesulfonic acid or 3,3'-dithiobis-1-propanesulfonic acid disodium salt is at a concentration of 0.0001-10 g/L.

In one embodiment, said sulfonic acid group substituted polycyclic aromatic hydrocarbons of 2-4 fused benzene rings or its alkali metal salt is selected from naphthalene-1,3,6-trisulfonic acid or naphthalene-1,3,6-trisulfonic acid trisodium salt.

In one embodiment, said naphthalene-1,3,6-trisulfonic acid or naphthalene-1,3,6-trisulfonic acid trisodium salt is at a concentration of 0.0001-10 g/L.

In one embodiment, said platinum(IV) complex of formula $M_2[Pt(C_2O_4)_x(OH)_y]$ is $K_2[trans\text{-}Pt(C_2O_4)_2(OH)_2]$.

In one embodiment, said $K_2[trans\text{-}Pt(C_2O_4)_2(OH)_2]$ is at a concentration of 0.0001-1 g/L.

In one embodiment, said polyethylene glycol is at a concentration of 0.001-5 g/L.

In one embodiment, comprising 22 g/L of potassium hexahydroxyplatinate(IV), 5.5 g/L of potassium hydroxide, 15 g/L of potassium oxalate, 0.05 g/L of saccharin sodium salt, 0.002 g/L of 3,3'-dithiobis-1-propanesulfonic acid disodium salt, 0.1 g/L of $K_2[trans\text{-}Pt(C_2O_4)_2(OH)_2]$ and 0.5 g/L of PEG 2000.

In one embodiment, comprising 18 g/L of sodium hexahydroxyplatinate(IV), 4 g/L of sodium hydroxide, 10 g/L of sodium oxalate, 0.05 g/L of saccharin sodium salt, 0.002 g/L of 3,3'-dithiobis-1-propanesulfonic acid disodium salt, 0.1 g/L of $K_2[trans\text{-}Pt(C_2O_4)_2(OH)_2]$, 0.2 g/L naphthalene-1,3,6-trisulfonic acid trisodium salt and 0.5 g/L of PEG 2000.

In one embodiment, said layer of platinum is at least 99.5 weight percent purity.

In one embodiment, said layer of platinum has an areal surface roughness expressed in arithmetical mean height of the surface ($S_a$) of at least 0.4 μm.

In one embodiment, said layer of platinum has a thickness of 0.1 μm to 300 μm.

In one embodiment, said substrate comprises one or more of platinum, copper, tin, bismuth, iron, nickel, silver, palladium, gold or their alloys.

This invention further provides method for depositing a layer of platinum on a substrate. In one embodiment, said method comprises the steps of: a) Providing a platinum electrodeposition bath, said platinum electrodeposition bath comprises: one or more sources of platinum; one or more alkali metal hydroxides; one or more conducting salts; saccharin or saccharin sodium salt; 3,3'-dithiobis-1-propanesulfonic acid or 3,3'-dithiobis-1-propanesulfonic acid disodium salt; sulfonic acid group substituted polycyclic aromatic hydrocarbons of 2-4 fused benzene rings or its alkali metal salt; a platinum(IV) complex of formula $M_2[Pt(C_2O_4)_x(OH)_y]$ as an additive; and polyethylene glycol with an average molecular weight ranging from 300 to 100,000; b) Providing an anode and a cathode to said platinum electrodeposition bath, wherein said cathode is said substrate; and c) Setting up a current between said cathode and anode.

In one embodiment, said anode is selected from the group consisting of graphite, stainless steel, and coated titanium. In another embodiment, said coated titanium comprises platinized titanium.

In one embodiment, said platinum electrodeposition bath is at a temperature of 65-90° C.

In one embodiment, said current is a DC current for producing a current density of 0.5-6 A/dm$^2$ on said substrate.

In one embodiment, said substrate comprises one or more of platinum, copper, tin, bismuth, iron, nickel, silver, palladium, gold or their alloys.

This invention further provides a decorative object comprising a layer of platinum. In one embodiment, said layer of platinum is produced by the method of this invention.

In one embodiment, said layer of platinum has a thickness of 0.1 μm to 300 μm.

In one embodiment, said layer of platinum has an areal surface roughness expressed in arithmetical mean height of the surface (Sa) of at least 0.4 μm.

In one embodiment, said layer of platinum is at least 99.5 weight percent purity.

In one embodiment, said decorative object is selected from the group consisting of ornament and jewelry.

In one embodiment, this invention provides a platinum electrodeposition bath for depositing a layer of platinum on a substrate, comprising an aqueous solution comprising: one or more sources of platinum; one or more alkali metal hydroxides; one or more conducting salts; saccharin or saccharin sodium salt; polyethylene glycol with an average molecular weight ranging from 300 to 100,000; platinum (IV) complex of formula $M_2[Pt(C_2O_4)_x(OH)_y]$, wherein M is any alkali metal; x is 1, 2 or 3; and y is 0, 2 or 4; and one or more additives selected from the group consisting of 3,3'-dithiobis-1-propanesulfonic acid, 3,3'-dithiobis-1-propanesulfonic acid disodium salt, and sulfonic acid group substituted polycyclic aromatic hydrocarbons or their alkali metal salts thereof, having at least two fused benzene rings.

In one embodiment, said 3,3'-dithiobis-1-propanesulfonic acid or 3,3'-dithiobis-1-propanesulfonic acid disodium salt is at a concentration of 0.0001-10 g/L.

In one embodiment, said sulfonic acid group substituted polycyclic aromatic hydrocarbons comprise formula (1):

$$Ar\text{—}(SO_3H)_n \quad (1)$$

wherein Ar stands for any polycyclic aromatic hydrocarbons having at least two fused benzene rings; and n is at least 1.

In one embodiment, said sulfonic acid group substituted polycyclic aromatic hydrocarbons comprise naphthalene-1,3,6-trisulfonic acid or naphthalene-1,3,6-trisulfonic acid trisodium salt.

In one embodiment, said sulfonic acid group substituted polycyclic aromatic hydrocarbons comprise up to four fused benzene rings.

In one embodiment, said sulfonic acid group substituted polycyclic aromatic hydrocarbons or their alkali metal salts are at a concentration of 0.0001-10 g/L.

In one embodiment, said platinum(IV) complex of formula $M_2[Pt(C_2O_4)_x(OH)_y]$ comprises $K_2[trans\text{-}Pt(C_2O_4)_2(OH)_2]$.

In one embodiment, M in said platinum (IV) complex of formula $M_2[Pt(C_2O_4)_x(OH)_y]$ is potassium.

In one embodiment, said platinum(IV) complex of formula $M_2[Pt(C_2O_4)_x(OH)_y]$ is at a concentration of 0.0001-1 g/L.

In one embodiment, said aqueous solution comprises 22 g/L of potassium hexahydroxyplatinate(IV), 5.5 g/L of potassium hydroxide, 15 g/L of potassium oxalate, 0.05 g/L of saccharin sodium salt, 0.002 g/L of 3,3'-dithiobis-1-propanesulfonic acid disodium salt, 0.1 g/L of $K_2[trans\text{-}Pt(C_2O_4)_2(OH)_2]$ and 0.5 g/L of PEG 2000.

In one embodiment, said aqueous solution comprises 18 g/L of sodium hexahydroxyplatinate(IV), 4 g/L of sodium hydroxide, 10 g/L of sodium oxalate, 0.05 g/L of saccharin sodium salt, 0.002 g/L of 3,3'-dithiobis-1-propanesulfonic acid disodium salt, 0.1 g/L of $K_2[trans\text{-}Pt(C_2O_4)_2(OH)_2]$, 0.2 g/L of naphthalene-1,3,6-trisulfonic acid trisodium salt and 0.5 g/L of PEG 2000.

In one embodiment, this invention provides a method for depositing a layer of platinum on a substrate, said method comprising the steps of: a) Providing the platinum electrodeposition bath of this invention; b) Providing an anode and a cathode to said platinum electrodeposition bath, wherein said cathode is said substrate; and c) Setting up a current between said cathode and anode, wherein a layer of platinum is deposited on a surface of said substrate.

In one embodiment, said platinum electrodeposition bath is at a temperature of 65-90° C.

In one embodiment, said current is a DC current for producing a current density of 0.5-6 A/dm$^2$ on said substrate.

In one embodiment, said substrate comprises one or more of platinum, copper, tin, bismuth, iron, nickel, silver, palladium, gold and any alloys thereof.

In one embodiment, said layer of platinum has a thickness of 0.1 μm to 300 μm.

In one embodiment, said layer of platinum has an areal surface roughness expressed in arithmetical mean height of the surface (Sa) of at least 0.4 μm.

In one embodiment, said layer of platinum is at least 99.5 weight percent pure.

In one embodiment, said substrate is an ornament or a piece of jewelry.

In one embodiment, said anode is selected from the group consisting of graphite, stainless steel, and coated titanium. In another embodiment, said coated titanium comprises platinized titanium.

In one embodiment, this invention provides a decorative object comprising a layer of platinum. In another embodiment, said decorative object is produced by the method of this invention.

In one embodiment, said layer of platinum has a thickness of 0.1 μm to 300 μm.

In one embodiment, said layer of platinum has an areal surface roughness expressed in arithmetical mean height of the surface (Sa) of at least 0.4 μm.

In one embodiment, said layer of platinum is at least 99.5 weight percent pure.

In one embodiment, said decorative object is an ornament or a piece of jewelry.

In one embodiment, this invention provides a decorative object comprising a layer of electrodeposited platinum, said layer of electrodeposited platinum has an areal surface roughness expressed in arithmetical mean height of the surface (Sa) of at least 0.4 μm.

In one embodiment, said layer of electrodeposited platinum has a thickness of 0.1 μm to 300 μm.

In one embodiment, said layer of electrodeposited platinum is at least 99.5 weight percent pure.

In one embodiment, said decorative object is an ornament or a piece of jewelry.

The invention will be better understood by reference to the Experimental Details which follow, but those skilled in the art will readily appreciate that the specific experiments detailed are only illustrative, and are not meant to limit the invention as described herein, which is defined by the claims which follow thereafter.

Throughout this application, various references or publications are cited.

Disclosures of these references or publications in their entireties are hereby incorporated by reference into this application in order to more fully describe the state of the art to which this invention pertains. It is to be noted that the transitional term "comprising", which is synonymous with "including", "containing" or "characterized by", is inclusive or open-ended and does not exclude additional, un-recited elements or method steps.

Example 1

A velvet platinum electrodeposition bath in an embodiment of this invention was prepared:

TABLE 1

| Component | Amount |
|---|---|
| Potassium hexahydroxyplatinate(IV), $K_2Pt(OH)_6$ | 22 g/L (Pt content) |

TABLE 1-continued

| Component | Amount |
|---|---|
| Potassium hydroxide | 5.5 g/L |
| Potassium oxalate | 15 g/L |
| Saccharin sodium salt | 0.05 g/L |
| 3,3'-Dithiobis-1-propanesulfonic acid disodium salt | 0.002 g/L |
| $K_2[trans\text{-}Pt(C_2O_4)_2(OH)_2]$ | 0.1 g/L |
| PEG 2000 | 0.5 g/L |

A platinum substrate was used as the cathode and platinized titanium acted as the anode. The bath was operated at 90° C., under a simple DC of 3 A/dm$^2$ current density. After 6 hours, a velvet platinum deposit (purity >99.5 weight %) was formed with a current efficiency >92%. The $S_a$ of the deposit was determined to be 0.737 μm by 3D surface profilometry.

Example 2

A velvet platinum electrodeposition bath in another embodiment of this invention was prepared:

TABLE 2

| Component | Amount |
|---|---|
| Sodium hexahydroxyplatinate(IV), $Na_2Pt(OH)_6$ | 18 g/L (Pt content) |
| Sodium hydroxide | 4 g/L |
| Sodium oxalate | 10 g/L |
| Saccharin sodium salt | 0.05 g/L |
| 3,3'-Dithiobis-1-propanesulfonic acid disodium salt | 0.002 g/L |
| $K_2[trans\text{-}Pt(C_2O_4)_2(OH)_2]$ | 0.1 g/L |
| Naphthalene-1,3,6-trisulfonic acid trisodium salt | 0.2 g/L |
| PEG 2000 | 0.5 g/L |

In this example, platinum was deposited on a platinum substrate, with platinized titanium as the anode. The bath was operated at 90° C., and a simple DC of 2 A/dm$^2$ current density was applied. After 12 hours, a velvet platinum deposit (purity >99.5 weight %) with shiny granular surface texture was formed. The current efficiency was >90%. The $S_a$ of the deposit was determined to be 0.509 μm by 3D surface profilometry.

What is claimed is:

1. A platinum electrodeposition bath for depositing a layer of platinum on a substrate, comprising an aqueous solution comprising:

a. one or more sources of platinum;

b. one or more alkali metal hydroxides;

c. one or more conducting salts;

d. saccharin or saccharin sodium salt;

e. polyethylene glycol with an average molecular weight ranging from 300 to 100,000;

f. platinum(IV) complex of formula $M_2[Pt(C_2O_4)_2(OH)_2]$, wherein M is any alkali metal; and g. one or more additives selected from the group consisting of 3,3'-dithiobis-1-propanesulfonic acid, 3,3'-dithiobis-1-propanesulfonic acid disodium salt, and sulfonic acid group substituted polycyclic aromatic hydrocarbons or their alkali metal salts thereof, having at least two fused benzene rings.

2. The platinum electrodeposition bath of claim 1, wherein said 3,3'-dithiobis-1-propanesulfonic acid or 3,3'-dithiobis-1-propanesulfonic acid disodium salt is at a concentration of 0.0001-10 g/L.

3. The platinum electrodeposition bath of claim 1, wherein said sulfonic acid group substituted polycyclic aromatic hydrocarbons comprise formula (1):

$$Ar—(SO_3H)_n \quad (1)$$

wherein Ar stands for any polycyclic aromatic hydrocarbons having at least two fused benzene rings; and n is at least 1.

4. The platinum electrodeposition bath of claim 1, wherein said sulfonic acid group substituted polycyclic aromatic hydrocarbons comprise naphthalene-1,3,6-trisulfonic acid or naphthalene-1,3,6-trisulfonic acid trisodium salt.

5. The platinum electrodeposition bath of claim 1, wherein said sulfonic acid group substituted polycyclic aromatic hydrocarbons comprise up to four fused benzene rings.

6. The platinum electrodeposition bath of claim 1, wherein said sulfonic acid group substituted polycyclic aromatic hydrocarbons or their alkali metal salts are at a concentration of 0.0001-10 g/L.

7. The platinum electrodeposition bath of claim 1, wherein said platinum(IV) complex of formula $M_2[Pt(C_2O_4)_2(OH)_2]$ comprises $K_2[trans\text{-}Pt(C_2O_4)_2(OH)_2]$.

8. The platinum electrodeposition bath of claim 1, wherein M in said platinum (IV) complex of formula $M_2[Pt(C_2O_4)_2(OH)_2]$ is potassium.

9. The platinum electrodeposition bath of claim 1, wherein said platinum(IV) complex of formula $M_2[Pt(C_2O_4)_2(OH)_2]$ is at a concentration of 0.0001-1 g/L.

10. The platinum electrodeposition bath of claim 1, said aqueous solution comprising 22 g/L of potassium hexahydroxyplatinate(IV), 5.5 g/L of potassium hydroxide, 15 g/L of potassium oxalate, 0.05 g/L of saccharin sodium salt, 0.002 g/L of 3,3'-dithiobis-1-propanesulfonic acid disodium salt, 0.1 g/L of $K_2[trans\text{-}Pt(C_2O_4)_2(OH)_2]$ and 0.5 g/L of polyethylene glycol (PEG) with an average molecular weight of 2000.

11. The platinum electrodeposition bath of claim 1, said aqueous solution comprising 18 g/L of sodium hexahydroxyplatinate(IV), 4 g/L of sodium hydroxide, 10 g/L of sodium oxalate, 0.05 g/L of saccharin sodium salt, 0.002 g/L of 3,3'-dithiobis-1-propanesulfonic acid disodium salt, 0.1 g/L of $K_2[trans\text{-}Pt(C_2O_4)_2(OH)_2]$, 0.2 g/L of naphthalene-1,3,6-trisulfonic acid trisodium salt and 0.5 g/L of polyethylene glycol (PEG) with an average molecular weight of 2000.

12. A method for depositing a layer of platinum on a substrate, said method comprising the steps of:

a. providing the platinum electrodeposition bath of claim 1;

b. providing an anode and a cathode to said platinum electrodeposition bath, wherein said cathode is said substrate; and c. setting up a current between said cathode and anode, wherein a layer of platinum is deposited on a surface of said substrate.

13. The method of claim 12, wherein said platinum electrodeposition bath is at a temperature of 65-90° C.

14. The method of claim 12, wherein said current is a DC current for producing a current density of 0.5-6 $A/dm^2$ on said substrate.

15. The method of claim 12, wherein said substrate comprises one or more of platinum, copper, tin, bismuth, iron, nickel, silver, palladium, gold and any alloys thereof.

16. The method of claim 12, wherein said layer of platinum has a thickness of 0.1 μm to 300 μm.

17. The method of claim 12, wherein said layer of platinum has an areal surface roughness expressed in arithmetical mean height of the surface (Sa) of at least 0.4 μm.

18. The method of claim 12, wherein said layer of platinum is at least 99.5 weight percent pure.

19. The method of claim 12, wherein said substrate is an ornament or a piece of jewelry.

20. The method of claim 12, wherein said anode is selected from the group consisting of graphite, stainless steel, and coated titanium.

21. The method of claim 20, wherein said coated titanium comprises platinized titanium.

* * * * *